United States Patent [19]

Rothhaas et al.

[11] 4,272,137

[45] Jun. 9, 1981

[54] FIRE RESISTANT CABINET WITH PROTECTIVE VOID IN GYPSUM FILLING

[75] Inventors: Friedrich Rothhaas, Bellheim; Günther Pichler, Germersheim, both of Fed. Rep. of Germany

[73] Assignee: Sistemco N.V., Curaco, Netherlands

[21] Appl. No.: 26,744

[22] Filed: Apr. 3, 1979

[30] Foreign Application Priority Data

Apr. 17, 1978 [CH] Switzerland ..... 4070781/78

[51] Int. Cl.[3] ..... E04B 2/34; B65D 25/18

[52] U.S. Cl. ..... 312/214; 109/80; 312/236

[58] Field of Search ..... 312/214, 236, 291; 109/80, 82, 84; 29/428

[56] References Cited

U.S. PATENT DOCUMENTS

| | | | |
|---|---|---|---|
| 3,272,580 | 9/1966 | Dean et al. | 312/214 |
| 3,705,754 | 12/1972 | Drum et al. | 312/214 |
| 3,817,589 | 6/1974 | Anderson | 312/214 |
| 3,888,557 | 6/1975 | Anderson et al. | 312/214 |

FOREIGN PATENT DOCUMENTS 134751 9/1902 Fed. Rep. of Germany .

*Primary Examiner*—Casmir A. Nunberg
*Attorney, Agent, or Firm*—Frishauf, Holtz, Goodman & Woodward

[57] ABSTRACT

In a heat resistant cabinet, a gypsum filling is provided in the interspace between the outer casing and the inner surface. In the upper part of the cabinet, at least one hollow space is present in the gypsum filling. This hollow space extends practically over the whole width and the whole depth of the cabinet. The ceiling is therefore provided by two relatively thin plates of gypsum spaced from each other and each containing a wire mesh for reinforcement, providing a good heat protection for the contents of the uppermost drawer, without adding any substantial vulnerability to impairment of heat protection by falling material or by falling of the cabinet.

7 Claims, 1 Drawing Figure

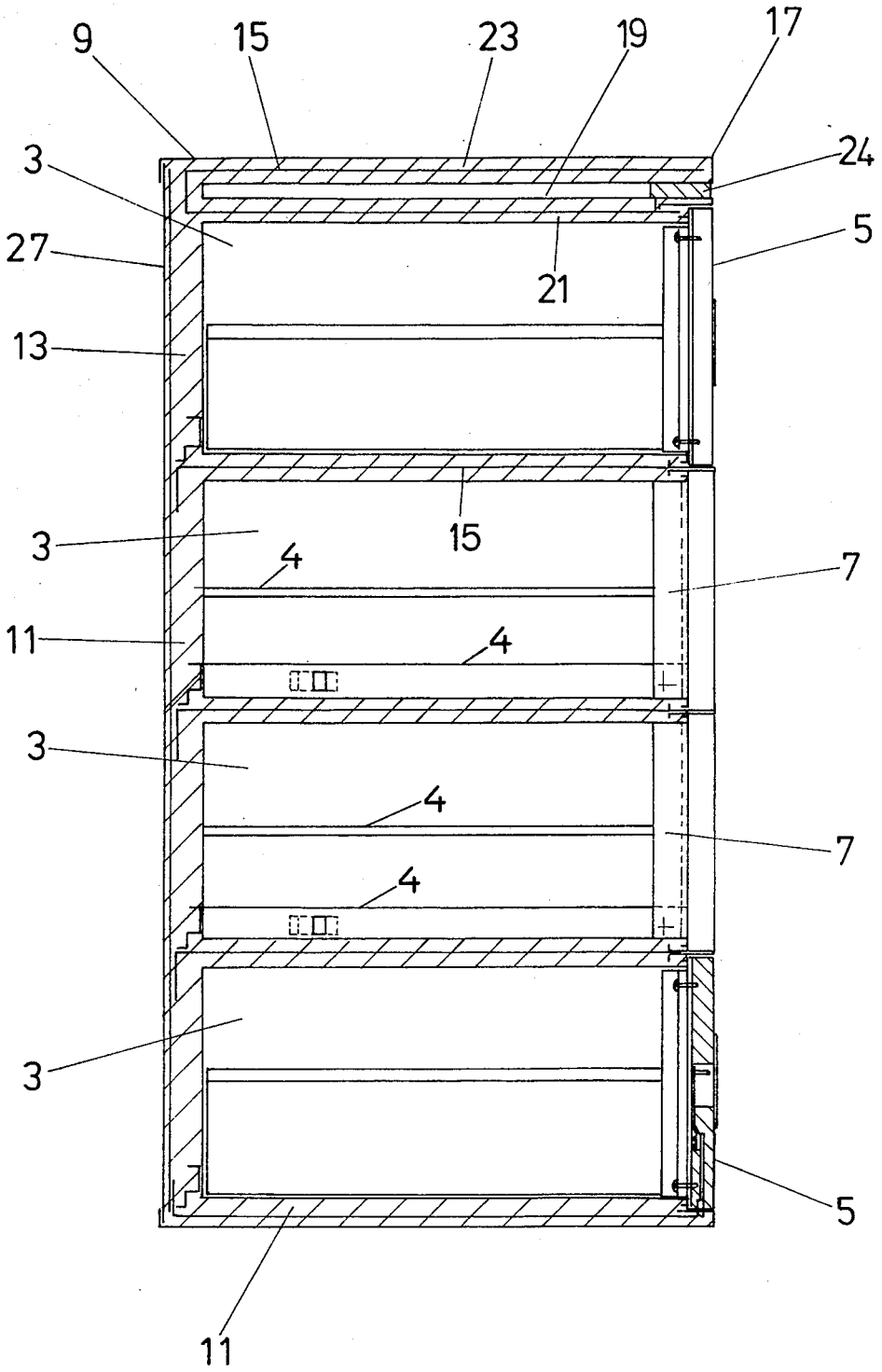
9
15
23
19
17
24
3
27
5
21
13
3
15
4
7
11
4
3
4
7
4
3
5
11

FIRE RESISTANT CABINET WITH PROTECTIVE VOID IN GYPSUM FILLING

This invention refers to a fire resistant cabinet, in which in the space between the outer casing and the inner surface a gypsum filling is provided. Such cabinets are usually drawer cabinets, but fire resistant cabinets are also made with doors.

In manufacturing such cabinets, the cabinet housing is usually made of an outer casing and an inner casing. Gypsum plaster is then filled into the space between, while the cabinet is positioned with its front side down. The gypsum plaster fills the interspaces between the outer casing and the inner casing. After setting of the gypsum plaster, the cabinet can be completed by mounting the rear wall. For years, such cabinets have generally served satisfactorily. In case of a fire, when the gypsum is heated, it slowly dissipates the water contained in the gypsum crystals. This causes, in known fashion, a cooling effect which is generally sufficient to protect the articles contained in the cabinet. In recent years, however, fire test requirements have become more severe. In such tests, impermissible temperatures have been encountered in the upper portion of cabinets of conventional design that is, in the case of a drawer cabinet, in the upper drawer thereof. To avoid this, a thicker top wall has been tried. This, however, did not improve the situation substantially. It is, therefore, generally assumed that the increased temperature in the upper drawer is not caused by insufficient insulation of the top wall, but by heat accumulation in the upper part of the compartment, as occurs in a heated room close to the ceiling, where the highest temperature is found. Accordingly, it was considered to be practically impossible to build, with conventional cheap means, a cabinet complying with the increased test requirements in the region of the upper drawer, as well as in the rest of the cabinet. It is, accordingly, an object of the present invention to build a fire resistant cabinet of the above-mentioned kind, in which, in case of a fire, no impermissible temperature will occur even in the upper part of the cabinet.

SUMMARY OF THE INVENTION

Briefly, at the top of the cabinet, one or more hollow spaces are provided in the gypsum filling, these hollow spaces extending practically over the whole width and depth of the cabinet. It has been found that, even under severe test requirements, no impermissible temperatures then occur in the upper region of the cabinet, for example in the upper drawer of a drawer cabinet. The exact explanation for this result is not yet fully clear. It would appear that the original assumption of heat accumulation in the upper drawer is not correct. It is therefore inferred that the air in the hollow space acts as heat insulation. Also, evaporation of water at the surfaces of the hollow spaces may have a temperature lowering effect.

Preferably, the hollow space or the hollow spaces extend in such a way over the width and depth of the cabinet that the gypsum filling in this region is formed substantially by two plates separated by the hollow space or the hollow spaces. In this case, heat transfer by convection in the gypsum filling is low. As each plate is relatively thin, it is also relatively flexible and may better suffer, without breakage, deformation caused by material falling on the cabinet during a fire. Even if the upper plate should break, the lower plate will provide heat protection.

Preferably, each plate is reinforced by a grid embedded in the gypsum. The grid preferably consists of wire mesh, but it is also possible to use a grid consisting of a suitable plastic material. Such a grid provides reinforcement, so that in the event the cabinet falls, no breaking up of the gypsum filling and no reduced insulating effect has to be feared. The gypsum filling preferably consists of porous gypsum. In porous gypsum, heat conduction is especially low because of the enclosed air bubbles.

The invention concerns also a method for manufacturing a cabinet. This method comprises the step of filling gypsum plaster into the cabinet positioned with its front side down and, after setting of the gypsum, the step of completing the outer casing by mounting the rear wall. In accordance with the invention, one or more cores are first provided to form the hollow spaces mentioned above and a gap is also left between each core and an open portion of the front of the cabinet as the gypsum plaster is put in place and, after setting of the gypsum and removal of the core or cores, the gap in front of each hollow space is then also filled with gypsum. This method permits easy manufacturing of the cabinet with conventional means. The gap for core removal can also be provided at the back with a supplementary core. After the first filling step, the core can be pulled from the hollow space through the aforesaid gap.

It is also possible to leave the core in the gypsum, in which case no removal gap need be provided for filling later. Further, it is possible to make the core of foamed plastics, particularly a fire resistant foamed plastic, such as polyurethane.

DRAWING

In the single FIGURE of the drawing, an embodiment of a fire resistant cabinet according to the invention is shown in section perpendicular to the cabinet front.

DESCRIPTION OF THE ILLUSTRATED EMBODIMENT

The illustrated cabinet comprises four drawer compartments 3. Only the top drawer and the bottom drawer 5 are shown. Each drawer compartment 3 comprises an inner frame 7 with rails 4 on which the drawer 5 can be moved. The inner frame 7 is preferably formed of sheet metal. The outer casing 9 of the cabinet also preferably consists of sheet metal. All interspaces 11 between the drawer compartments 3 and the outer casing 9 are filled with a gypsum filling 13. The gypsum filling consists preferably of porous gypsum. Grids 15, wire meshes in the illustrated case, are provided for reinforcement.

It is important to note, that in accordance with the invention, in the upper portion 17 of the cabinet, a hollow space 19 is provided in the gypsum filling. This hollow space extends substantially over the whole width and depth of the cabinet, i.e. it has approximately the same horizontal dimensions as the usable area of a drawer 5.

In this way, the gypsum filling in this area is divided into two plates 21, 23 located one above the other. In the front portion of the hollow space 19, a piece of gypsum 24 is inserted to seal it towards the drawer front. The hollow space 19 can also be filled with foamed plastics. Each plate 21, 23 is preferably reinforced by a wire mesh 15. The wire mesh 15 can be bent in U-form as shown in the drawing, so that a single piece of wire mesh serves for reinforcement of both plates 21 and 23.

As tests have shown, the described construction of the upper portion of the cabinet prevents occurrence of impermissible temperatures there, or as in the example shown, in the uppermost drawer. It should be noted that the same construction can also be used for cabinets with doors.

The gypsum filling consists preferably of porous gypsum. Porous gypsum provides excellent insulation. As already mentioned, it is not fully clear, why the construction shown leads to the favorable results. It is believed that the hollow space has an insulating effect, but the evaporation surfaces formed by the surfaces of the hollow space may also contribute to favorable temperature conditions in the upper drawer compartment. It is also important that, in case of a fire, destruction of the gypsum filling in the upper portion and consequent adverse effects are practically prevented. Because the plate 23 is relatively thin it may support a higher deformation than a thick plate of gypsum. Even if the plate 23 should be cracked by falling material, the protective effect of plate 21 still remains.

The cabinet according to the invention is preferably manufactured by filling gypsum plaster into the cabinet positioned with its front side down. For forming a hollow space 19, a core may be provided which, after setting of the gypsum plaster, will be removed through a gap left in front of the core when the filling is provided. With the cabinet now upright, the gap is filled by a further plaster filling 24. After the gypsum has set, the outer casing is completed by mounting the back wall. When the cores are removed from the front, the back wall can be mounted before the front gaps are filled, but it is also possible to provide the gaps for removing the cores at the back, in which case the gaps are filled and that filling set before the back wall is put on. It is also possible to leave the core in the gypsum, in which case no gap needs to be provided before completion of the filling stage. In this case, the core is preferably formed of heat resistant foamed plastic material, e.g. foamed urethane.

Instead of a single hollow space 19, also a plurality of hollow spaces may be provided on top of each other or side by side. However, it is of advantage for just a single extensive space 19 to be provided in any one plane, so that above the drawer compartment, between the plates 21 and 23, no webs are provided which could transfer heat or mechanical shock from the plate 23 to the plate 21.

We claim:

1. A fire resistant cabinet having an outer casing and an inner wall surface and a gypsum filling therebetween, comprising the improvement which consists in that the top (17) portion of the gypsum filling (13) of the cabinet one or more hollow spaces (19) are provided, said hollow space or spaces extending practically over the whole width and depth of the cabinet and having no communication with any hollow spaces in other portions of said gypsum filling.

2. A cabinet according to claim 1, in which said hollow space or spaces extend in such a way over the width and depth of the cabinet that the gypsum filling in this region is formed substantially by two plates (21,23) separated by the hollow space or spaces (19).

3. A cabinet according to claim 2, in which only one said hollow space (19) is provided.

4. A cabinet according to claim 2, in which each hollow space (19) is filled by foamed plastics.

5. A cabinet according to claim 2, in which each plate (21,23) is reinforced by a grid (15) of tougher material embedded in the gypsum.

6. A cabinet according to claim 5, in which said grid (15) consists of wire mesh.

7. A cabinet according to any of claims 1 to 6, in which the gypsum filling consists of porous gypsum.

* * * * *